US006112621A

United States Patent [19]

Ochiai

[11] Patent Number: 6,112,621

[45] Date of Patent: Sep. 5, 2000

[54] SCREW ROTATING TOOL

[76] Inventor: Hiroshi Ochiai, 358-4, Oaza Nakamachi, Seki-cho, Suzuka-gun, Mie, Japan

[21] Appl. No.: 09/328,509

[22] Filed: Jun. 9, 1999

[30] Foreign Application Priority Data

Sep. 3, 1998 [JP] Japan ..... 10-267452
Dec. 28, 1998 [JP] Japan ..... 10-373722

[51] Int. Cl.[7] ..... B25B 17/00

[52] U.S. Cl. ..... 81/57.29; 81/57.13

[58] Field of Search ..... 81/57.29, 58.1, 81/60, 61, 62, 63, 63.1, 63.2, 476, 477, 57, 58, 57.13, 57.28

[56] References Cited

U.S. PATENT DOCUMENTS

| | | | |
|---|---|---|---|
| 4,311,072 | 1/1982 | Hudgins | 81/476 |
| 4,474,089 | 10/1984 | Scott | 81/57.29 |
| 4,528,873 | 7/1985 | Lee | 81/57.29 |
| 6,047,616 | 4/2000 | Ochiai | 81/57.29 |

FOREIGN PATENT DOCUMENTS 8-141921 6/1996 Japan .

*Primary Examiner*—Timothy V. Eley
*Assistant Examiner*—Dung Van Nguyen
*Attorney, Agent, or Firm*—McDermott, Will & Emery

[57] ABSTRACT

Merely a handle-rotating operation allows a screw part such as a bolt or a nut to be tightened or loosened without rotating the screw part when the handle is rotated in a reverse direction. A frame of a screw-rotating tool supports a socket shaft rotatably. A transmission shaft and a handle shaft are rotatably supported on the frame in an axial direction different from an axial direction of the socket shaft. The screw-rotating tool includes a rotation transmission mechanism connecting the socket shaft and the transmission shaft with each other, with the axial direction of the socket shaft and that of the transmission shaft different from each other; a first reverse rotation prevention mechanism formed on the frame to limit both-way rotation of the transmission shaft to one-way rotation; and a second reverse rotation prevention mechanism limiting both-way rotation of the handle shaft to be transmitted to the transmission shaft to one-way rotation.

6 Claims, 10 Drawing Sheets

SCREW ROTATING TOOL

BACKGROUND OF THE INVENTION

1. Field of the Invention

The present invention relates to a screw-rotating tool to be used to tighten or loosen screw parts such as bolts, nuts, and the like.

2. Description of the Related Art

A tightening means using screw parts such as bolts, nuts, and the like is widely used nowadays because it is convenient and secures strength. Although spanners, monkey wrenches, and the like are used to tighten or loosen the screw parts, a ratchet tool incorporating a ratchet mechanism is superior to them because the ratchet tool can be used conveniently.

As shown in FIG. 10, in the ratchet tool, a handle (a) is pivoted within a predetermined angle. As a result, a click (b) rotates a ratchet wheel (c), and a socket (d) integral with the ratchet wheel (c) can be rotated in one direction. An engaging portion (e) of the ratchet tool engaging a screw part is formed on the inner peripheral surface of the socket (d). An urging spring (f) is installed proximately to the click (b). Accordingly, it is possible to tighten or loosen the screw part easily by engaging the socket (d) with the screw part only once in the socket (d), unlike a spanner which requires a worker to engage the socket (d) with the screw part repeatedly.

However, the ratchet tool has a limited operable range: When the resistance between a female screw and a bolt becomes smaller than that between the ratchet wheel and the click in loosening the bolt, the bolt is rotated even by reverse pivotal motions (tightening direction) of the handle, with the ratchet mechanism being unoperative. A similar situation occurs from an initial stage to an intermediate stage in a bolt-tightening operation. Thus, the ratchet tool is not useful except the final stage in the bolt-tightening operation.

In order to overcome such a problem, there is disclosed in Japanese Laid-Open Patent Publication No. 8141921 an art of installing a hand ring on the periphery of the socket of the ratchet tool. The hand ring is rotated to tighten or loosen the bolt when the resistance between the female screw and the bolt becomes small. The operation of rotating the hand ring is troublesome.

SUMMARY OF THE INVENTION

It is an object of the present invention to provide a screw-rotating tool capable of tightening or loosening a screw part such as a bolt or a nut throughout a screw-tightening or a screw-loosening operation by merely rotating a grip handle thereof, without rotating the screw part when the handle is rotated in a reverse direction.

In order to achieve the object, there is provided a screw-rotating tool comprising a frame rotatably supporting a socket shaft; a transmission shaft and a handle shaft rotatably supported on the frame in an axial direction different from an axial direction of the socket shaft; a rotation transmission mechanism connecting the socket shaft and the transmission shaft with each other, with the axial direction of the socket shaft and that of the transmission shaft different from each other; a first reverse rotation prevention mechanism formed on the frame to limit both-way rotation of the transmission shaft to one-way rotation; and a second reverse rotation prevention mechanism limiting both-way rotation of the handle shaft to be transmitted to the transmission shaft to one-way rotation.

According to the screw-rotating tool of the present invention, the transmission shaft and the handle shaft are rotatably supported on the frame in the axial direction different from the axial direction of the socket shaft. Further, the first reverse rotation prevention mechanism and the second reverse rotation prevention mechanism operate independently of each other. Therefore, merely a handle-rotating operation allows a screw part such as a bolt or a nut to be tightened or loosened easily and reliably, without rotating the screw part when the grip handle is rotated in a reverse direction. Thus, the screw-rotating tool of the present invention is very effective for improving workability.

Further objects and advantages of the present invention will be apparent from the following detailed description, reference being made to the accompanying drawings, wherein preferred embodiments of the present invention are clearly shown.

DETAILED DESCRIPTION OF THE PREFERRED EMBODIMENTS

The screw-rotating tool according to the embodiments of the present invention will be described below with reference to the drawings.

(1) Embodiment 1

Figure 1:
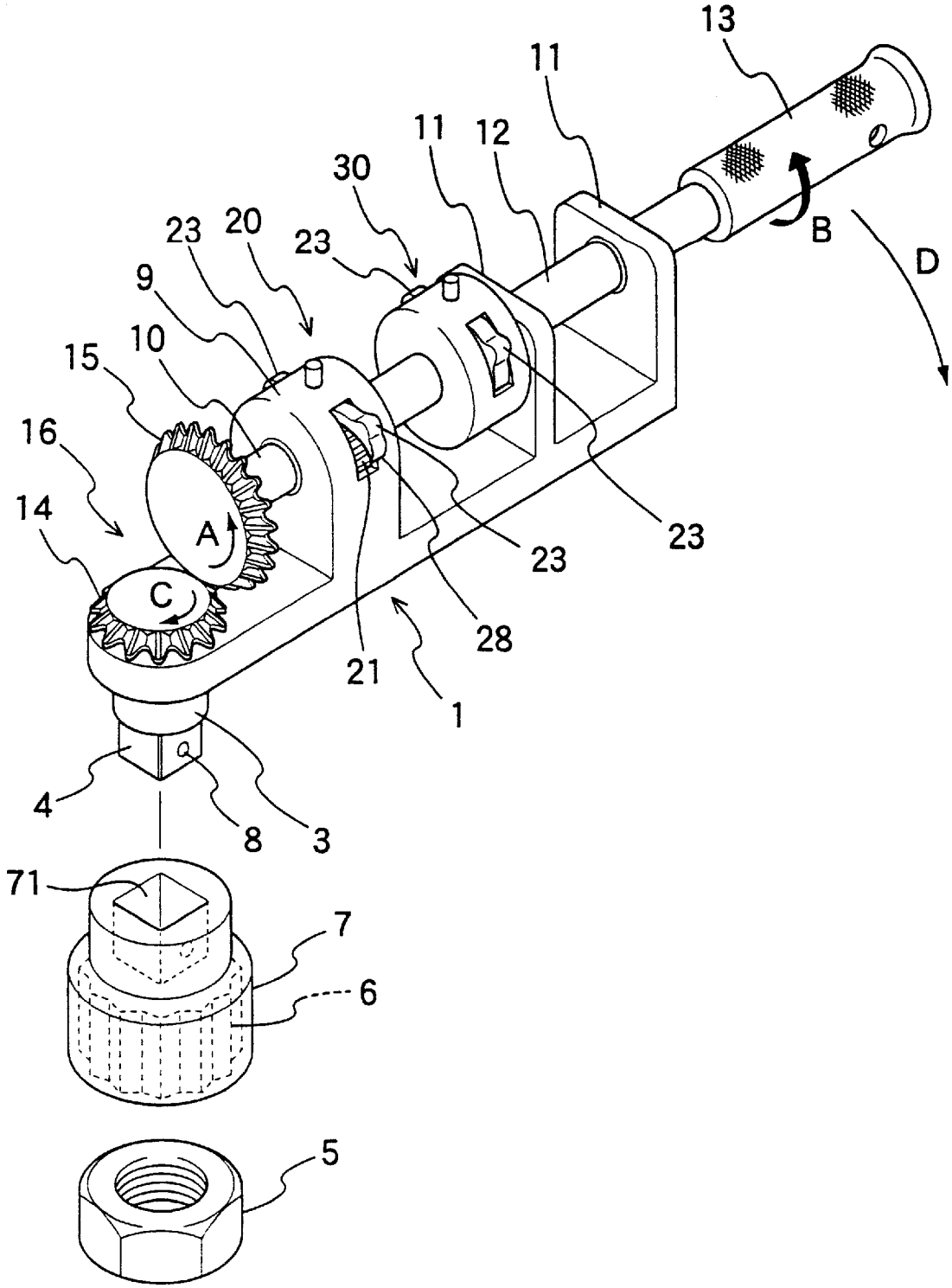
FIG. 1 is a perspective view showing a screw-rotating tool according to an embodiment 1 of the present invention.
Figure 2:
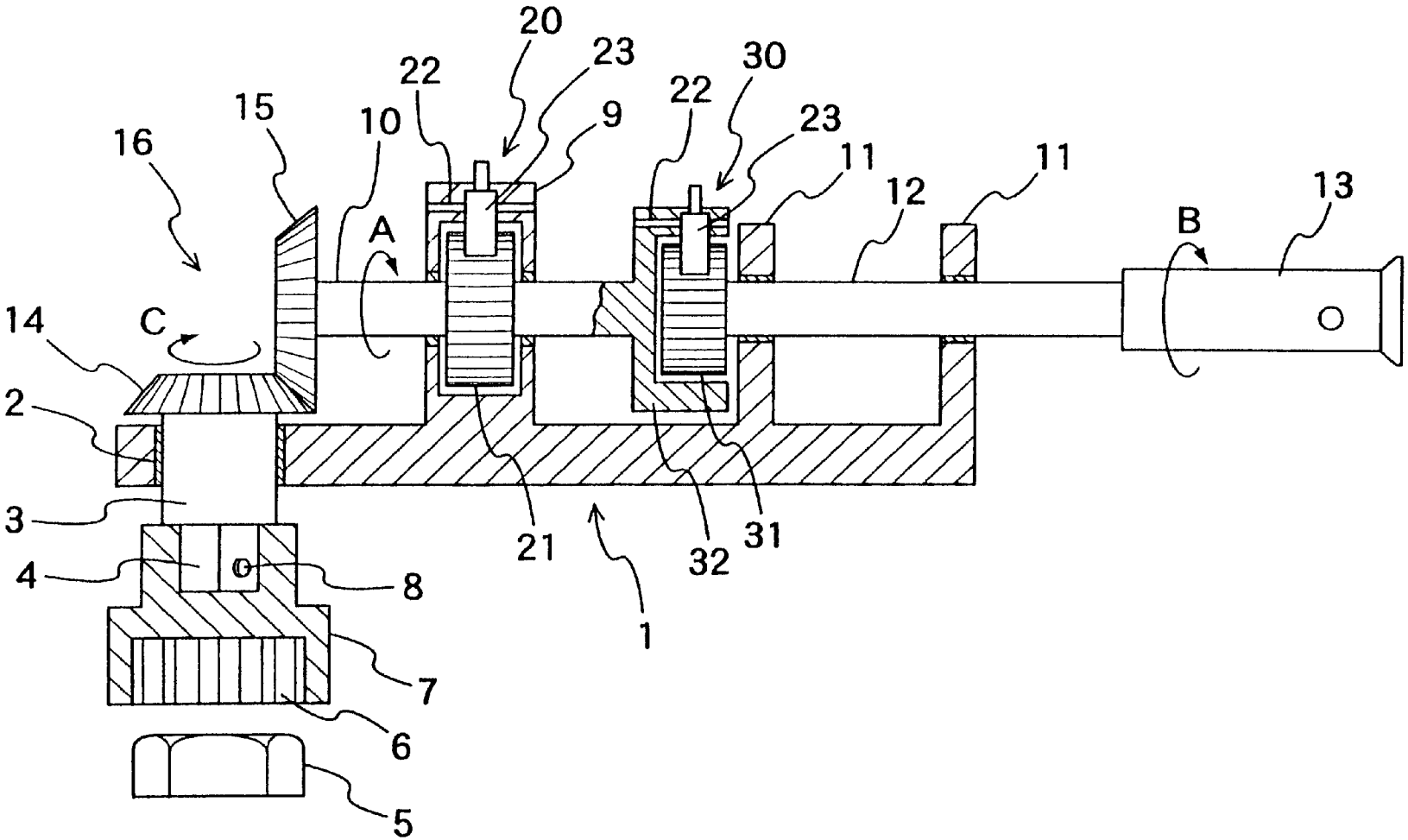
FIG. 2 is a side view partly in section showing the screw-rotating tool shown in FIG. 1.
Figure 3:
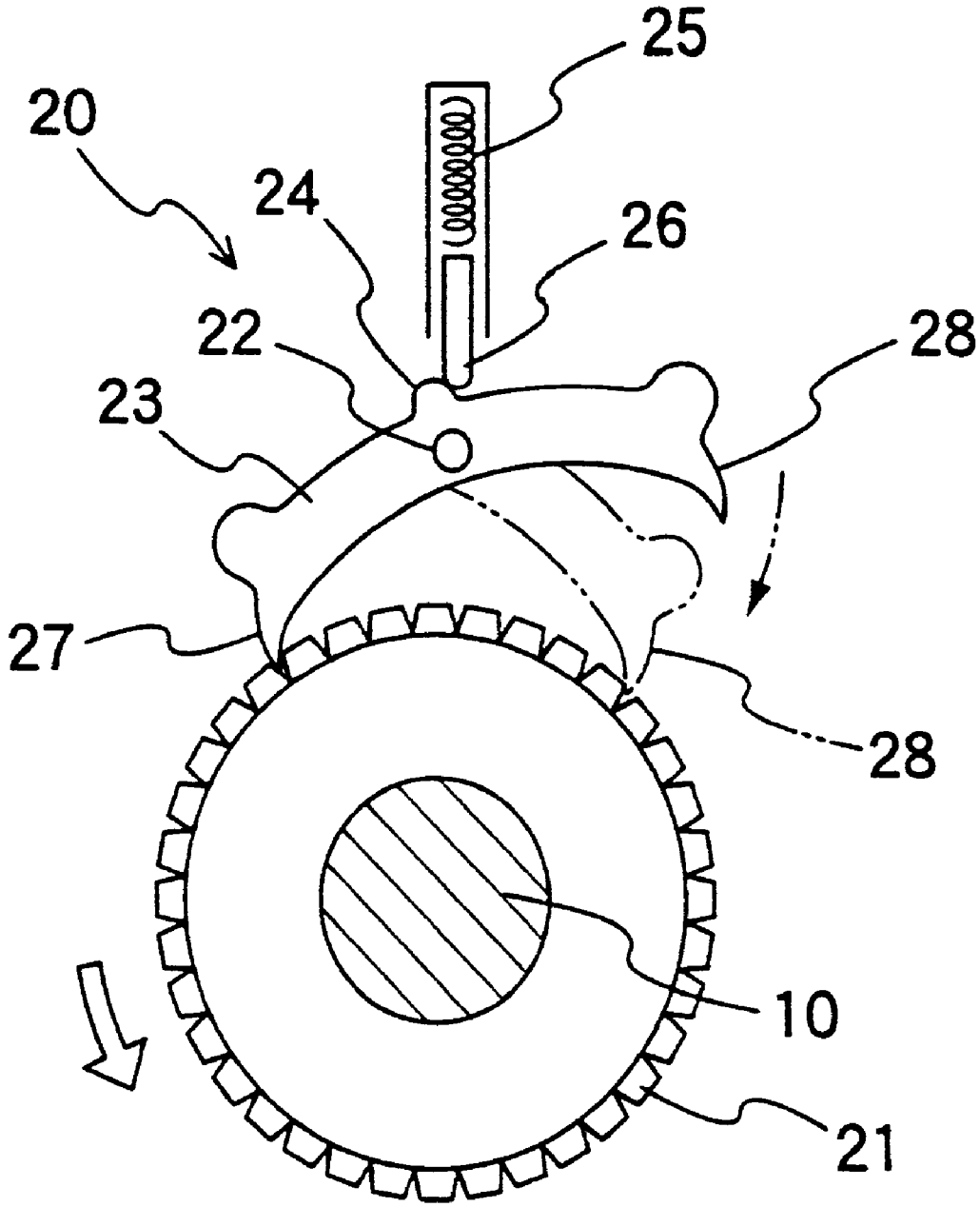
FIG. 3 is an explanatory view showing a reverse rotation prevention mechanism capable of switching a rotational direction.

FIGS. 1 through 3 show the screw-rotating tool according to the embodiment 1 of the present invention. FIG. 1 shows the exterior of the screw-rotating tool. FIG. 2 is a side view partly in section showing the screw-rotating tool shown in FIG. 1. FIG. 3 shows the construction of a ratchet mechanism. Referring to FIGS. 1 and 2, a socket shaft 3 is rotatably supported by a bearing 2 positioned proximately to one end of an angled frame 1. The front end 4 of the socket shaft 3 is square pillar-shaped. A plurality of sockets 7 is removably installed on the front end 4 of the socket shaft 3 by utilizing an installing hole 71 thereof. The diameters of holes 6 of the respective sockets 7 are different from one another. Thus, the socket 7 can be installed on the front end 4 selectively according to the outer diameter of a screw part 5. There is formed an engaging projection 8 formed at the front end 4 of the socket shaft 3 to prevent the socket 7 from being dropped from the front end 4.

A transmission shaft 10 and a handle shaft 12 are rotatably supported on the frame 1 in an axial direction different from the axial direction of the socket shaft 3. More specifically, the transmission shaft 10 is supported by a bearing 9 fixed to the frame 1 such that the transmission shaft 10 is rotatable in an axial direction (in a plane) substantially perpendicular to the socket shaft 3; and the handle shaft 12 is rotatably supported by a bearing 11 fixed to the frame 1 such that the handle shaft 12 aligns with the transmission shaft 10. A grip handle 13 is installed on the handle shaft 12 at the rear end thereof.

A bevel wheel 14 fixed to the base (rear end) of the socket shaft 3 engages a bevel wheel 15 fixed to the front end of the transmission shaft 10. The bevel wheels 14 and 15 constitute a rotation transmission mechanism 16 transmitting the rotation of the transmission shaft 10 to the socket shaft 3 substantially perpendicular thereto. Because the number of teeth of the bevel wheel 15 is set a little larger than that of the bevel wheel 14, the rotation of the transmission shaft 10 is transmitted to the socket shaft 3 such that the rotational speed of the socket shaft 3 is higher than that of the transmission shaft 10.

The screw-rotating tool has a first reverse rotation prevention mechanism 20 provided on a part of the bearing 9 positioned on the frame 1. In the embodiment 1, the first reverse rotation prevention mechanism 20 is composed of a ratchet mechanism limiting both-way rotation of the transmission shaft 10 to one-way rotation. As shown in FIG. 3, in the ratchet mechanism 20, the peripheral surface of the transmission shaft 10 is convex and concave to form a ratchet wheel 21, and a pawl 23 is pivotally supported on a part of the bearing 9 by a pin 22. The pawl 23 is symmetrical with respect to the pin 22. A press pin 26 is urged by a spring 25 to contact the press pin 26 with a projection 24 formed on the rear surface of the pawl 23. As a result, one side of the pawl 23 is moved downward, as shown in FIG. 3, and the lower end 27 of one side of the pawl 23 engages the ratchet wheel 21. Consequently, the transmission shaft 10 rotates in only the direction shown with a white arrow of FIG. 3, and a reverse rotation thereof is locked. When the other side of the pawl 23 is moved downward, as shown with a two-dot chain line of FIG. 3, the lower end 28 of the other side of the pawl 23 engages the ratchet wheel 21. As a result, the transmission shaft 10 is capable of rotating in the direction opposite to the direction shown with the white arrow of FIG. 3. That is, the rotational direction of the transmission shaft 10 can be switched by moving one side of the pawl 23 or the other side thereof upward.

The screw-rotating tool has a second reverse rotation prevention mechanism 30 limiting both-way rotation of the handle shaft 12 to be transmitted to the transmission shaft 10 to one-way rotation. The second reverse rotation prevention mechanism 30 includes a ratchet mechanism similar to that of the first reverse rotation prevention mechanism 20. That is, to constitute the second reverse rotation prevention mechanism 30, the peripheral surface of the front end of the handle shaft 12 is convex and concave to form a ratchet wheel 31, and a cylindrical portion 32 surrounding the ratchet wheel 31 is formed on the base (rear end) of the transmission shaft 10. Similarly to the first reverse rotation prevention mechanism 20 described above with reference to FIG. 3, the pawl 23 is pivotally supported on the cylindrical portion 32 by the pin 22. The pawl 23 is symmetrical with respect to the pin 22. The press pin 26 is urged by the spring 25 to contact the press pin 26 with the projection 24 formed on the rear surface of the pawl 23. As a result, one side or the other side of the pawl 23 is moved downward, as shown in FIG. 3 thereby to switch the rotational direction of the handle shaft 12 to be transmitted to the transmission shaft 10.

As shown in FIG. 1, when the screw part 5 such as a nut or a bolt is tightened by the screw-rotating tool having the above-described construction, the first reverse rotation prevention mechanism 20 is set such that the transmission shaft 10 is rotated in only the direction shown with an arrow A, and the second reverse rotation prevention mechanism 30 is set such that the rotation of the handle shaft 12 in only the direction shown with the arrow A is transmitted to the transmission shaft 10. Then, the socket 7 having a size suitable for the screw part 5 is installed on the front end 4 of the socket shaft 3, and the screw part 5 is fitted in the socket 7. Then, gripping the grip handle 13, an operator rotates it with the wrist in the direction shown with an arrow B to rotate the handle shaft 12 in the direction shown with the arrow B. As a result, the rotation of the handle shaft 12 is transmitted to the transmission shaft 10 through the second reverse rotation prevention mechanism 30, and the transmission shaft 10 is rotated in the direction shown with the arrow A. The pawl 23 of the second reverse rotation prevention mechanism 30 engages the ratchet wheel 31 thereof, and thus the handle shaft 12 and the transmission shaft 10 rotate together. The transmission shaft 10 rotates in the direction shown with the arrow A, with the pawl 23 of the first reverse rotation prevention mechanism 20 sliding on the ratchet wheel 21 thereof. The rotation of the transmission shaft 10 is transmitted to the bevel wheel 14 from the bevel wheel 15 thereby to rotate the socket shaft 3 in a direction shown with an arrow C of FIG. 1. Thus, the screw part 5 is rotated in a tightening direction. The handle shaft 12 is rotated in the direction shown with the arrow B and in the direction opposite thereto reciprocatorily by rotating the grip handle 13 reciprocatorily with the wrist, with the operator gripping it. In this operation, the rotation of the handle shaft 12 in the direction opposite to the direction shown with the arrow B is trapped by the second reverse rotation prevention mechanism 30 and thus not transmitted to the transmission shaft 10. The pawl 23 of the second reverse rotation prevention mechanism 30 slides on the ratchet wheel 31 thereof, and the handle shaft 12 idles. The pawl 23 of the first reverse rotation prevention mechanism 20 engages the ratchet wheel 21 thereof, and thus the transmission shaft 10 is incapable of following the idling motion of the handle shaft 12. Accordingly, it is possible to rotate the screw part 5 in only the tightening direction by rotating the handle shaft 12 reciprocatorily several times.

In the conventional ratchet tool, when the screw part 5 is in a loosened state, the screw part 5 rotates together with the socket of the conventional ratchet tool when the socket rotates in a screw-loosening direction. On the other hand, according to the present invention, it is possible to prevent the screw part 5 from rotating together with the handle shaft 12 when the handle shaft 12 is rotated in the loosening direction. This is because the axial direction of the socket shaft 3 and that of the transmission shaft 10 are different from each other, and because the screw-rotating tool has the first reverse rotation prevention mechanism 20 and the second reverse rotation prevention mechanism 30. Thus, it is possible to rotate the screw part 5 in the tightening direction securely by reciprocatorily rotating the grip handle 13 with the wrist within a predetermined range, with the operator keeping gripping the grip handle 13.

When the screw part 5 is tightened to some extent, the operator feels it heavy to rotate the handle shaft 12 in the direction shown with the arrow B. At this time, the screw part 5 can be tightened further by the action of levers by pulling the screw-rotating tool in the direction shown with an arrow D of FIG. 1. Owing to the operation of the first reverse rotation prevention mechanism 20 and the second reverse rotation prevention mechanism 30, it is possible to tighten the screw part 5 at a great force without fitting the screw part 5 into the socket 7 again.

The socket 7 can be rotated at a high speed by transmitting the rotation of the transmission shaft 10 to the socket shaft 3 such that the rotational speed of the socket shaft 3 is higher than that of the transmission shaft 10. To do so, the number of teeth of the bevel wheel 15 is set a little larger than that of the bevel wheel 14.

The foregoing description has been made on the operation of tightening the screw part such as a nut or a bolt. The screw part can be loosened easily by setting the first reverse rotation prevention mechanism 20 such that the transmission shaft 10 is rotated in only the direction opposite to the direction shown with the arrow A, and the second reverse rotation prevention mechanism 30 such that the rotation of the handle shaft 12 in only the direction opposite to the direction shown with the arrow A is transmitted to the transmission shaft 10. To remove the screw part, with the operator gripping the grip handle 13, the operator rotates the wrist clockwise and counterclockwise reciprocatorily to rotate the handle shaft 12 clockwise and counterclockwise reciprocatorily. The number of teeth of the bevel wheel 15 may be set a little smaller than that of the bevel wheel 14.

(2) Embodiment 2

Figure 4:
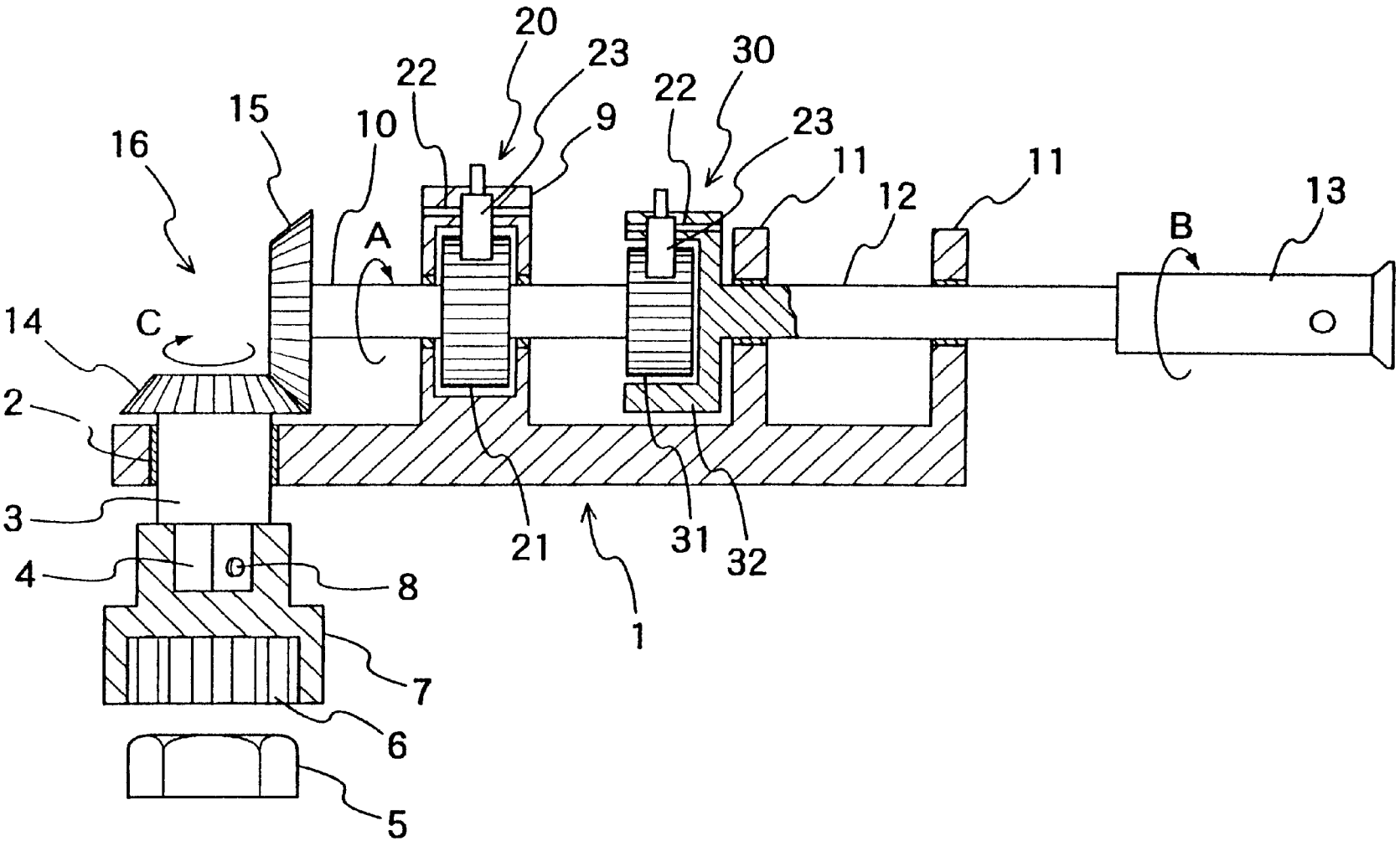
FIG. 4 is a side view partly in section showing a screw-rotating tool according to an embodiment 2 of the present invention.

As shown in FIG. 4, in the screw-rotating tool of the embodiment 2, the peripheral surface of the base (rear end) of the transmission shaft 10 is convex and concave to form the ratchet wheel 31, and the cylindrical portion 32 surrounding the ratchet wheel 31 is formed on the front end of the handle shaft 12 to form the second reverse rotation prevention mechanism 30. The pawl 23 of the second reverse rotation prevention mechanism 30 is pivotally supported on the cylindrical portion 32 by the pin 22. The pawl 23 is symmetrical with respect to the pin 22. The press pin 26 (see FIG. 3) is urged by the spring 25 to contact the press pin 26 with the projection 24 formed on the rear surface of the pawl 23. As a result, one side or the other side of the pawl 23 is moved downward, as shown in FIG. 3 thereby to switch the direction of rotation of the handle shaft 12 to be transmitted to the transmission shaft 10. Other constructions of the screw-rotating tool of the embodiment 2 are similar to those of the screw-rotating tool of the embodiment 1, and also the fundamental operation of the screw-rotating tool of the embodiment 2 is the same as that of the embodiment 1 shown in FIGS. 1 and 2.

In the screw-rotating tool having the construction, the ratchet wheels 21 and 31 can be formed in one body on the transmission shaft 10. Thus, in addition to the operation and effect of the embodiment 1, the screw-rotating tool of the embodiment 2 has a construction simpler than the screw-rotating tool of the embodiment 1.

(3) Embodiment 3

Figure 5:
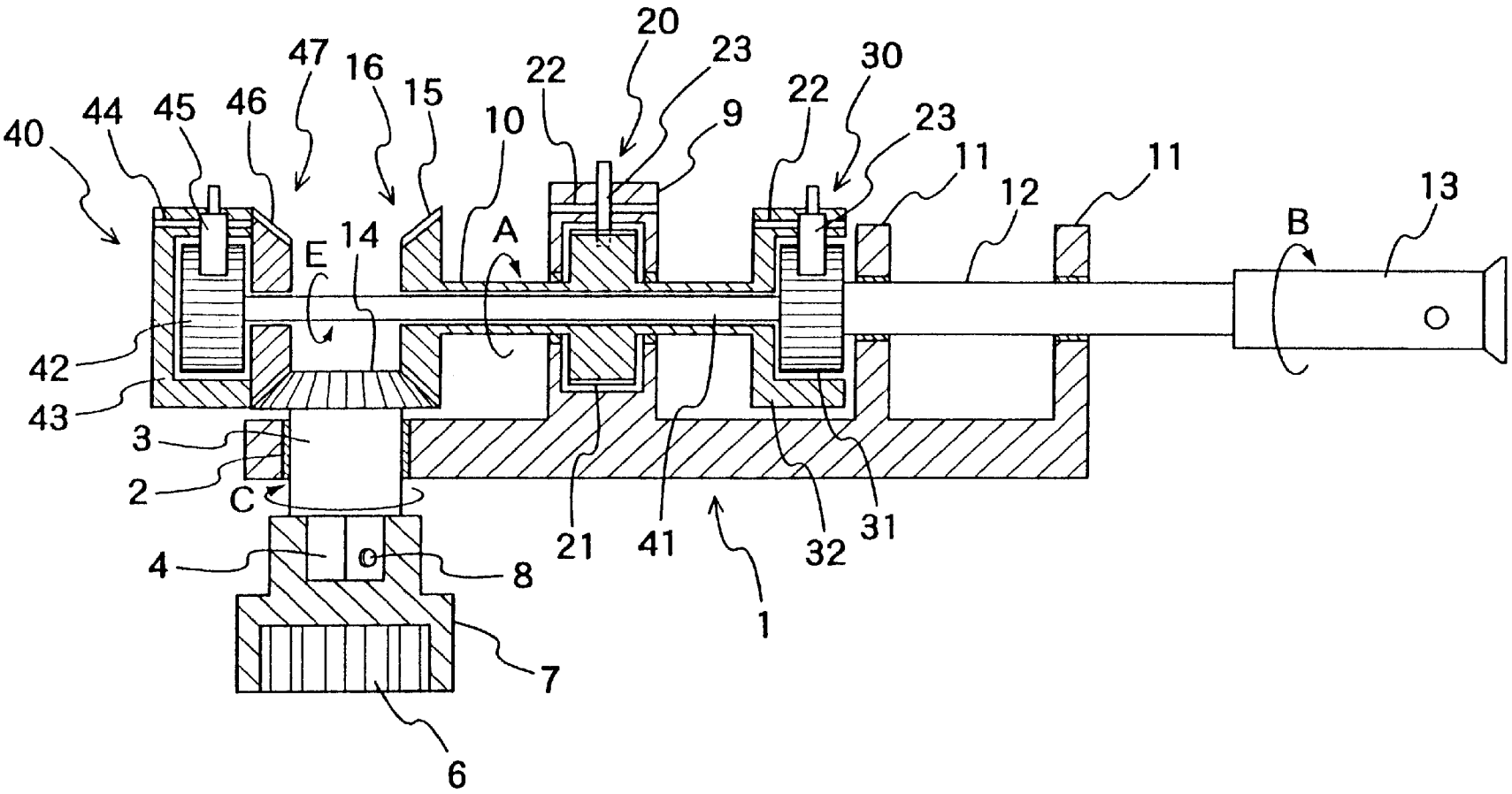
FIG. 5 is a side view partly in section showing a screw-rotating tool according to an embodiment 3 of the present invention.

The screw-rotating tool of the embodiment 3 is described below with reference to FIG. 5. The socket shaft 3 can be rotated clockwise in reciprocatory both-way rotation, of the handle shaft 12, which is accomplished by rotating the grip handle 13 with the wrist. To accomplish this operation, the screw-rotating tool has a third reverse rotation prevention mechanism 40.

An extension shaft 41 projecting forward from the front end of the handle shaft 12 is freely inserted through a hollow transmission shaft 10. A ratchet wheel 42 is formed at the front end of the extension shaft 41. The third reverse rotation prevention mechanism 40 limits both-way rotation of the socket shaft 3 to be transmitted from the handle shaft 12 to one-way rotation. Similarly to the construction shown in FIG. 3, in the third reverse rotation prevention mechanism 40, a pawl 45 is pivotally supported by a pin 44 on a cylindrical portion 43 surrounding the ratchet wheel 42. It is possible to switch the direction of the rotation of the cylindrical portion 43 which can be transmitted from the handle shaft 12 by moving one side or the other side of the pawl 45 downward. A bevel wheel 46 is fixed to one side of the cylindrical portion 43 to engage the bevel wheel 46 with the bevel wheel 14, with the bevel wheel 46 confronting the bevel wheel 15 thereby to constitute a reversal rotation transmission mechanism 47 of the bevel wheels 14, 15, and 46. The rotation of the handle shaft 12 is transmitted to the socket shaft 3 by reversing the rotational direction of the handle shaft 12 through the reversal rotation transmission mechanism 47. The grip handle 13, the handle shaft 12, the ratchet wheel 31, the extension shaft 41, and the ratchet wheel 42 are first integral parts. The cylindrical portion 32, the transmission shaft 10, the ratchet wheel 21, and the bevel wheel 15 are second integral parts. The cylindrical portion 43 and the bevel wheel 46 are third integral parts. Each of the first through the third integral parts is operable independently. The first integral parts engage the second integral parts through the second reverse rotation prevention mechanism 30 and also engage the third integral parts through the third reverse rotation prevention mechanism 40. The second integral parts engage the first integral parts and the frame 1 through the first reverse rotation prevention mechanism 20. Because other constructions of the screw-rotating tool of the embodiment 3are similar to those of the screw-rotating tool of the embodiment 1, the descriptions thereof are omitted herein. The same reference numerals of the screw-rotating tool of the embodiment 3 as those of the screw-rotating tool of the embodiment 1 denote the same parts as those of the screw-rotating tool of the embodiment 1 or parts corresponding thereto.

When the screw part 5 is tightened by the screw-rotating tool having the construction, the first, second, and third reverse rotation prevention mechanism 20, 30, and 40 are set as follows: The first reverse rotation prevention mechanism 20 is so set that the transmission shaft 10 is rotatable in only the direction shown with an arrow A. The second reverse rotation prevention mechanism 30 is so set that the rotation of the handle shaft 12 in only the direction shown with the arrow A is transmitted to the transmission shaft 10. The third reverse rotation prevention mechanism 40 is so set that the rotation of the extension shaft 41 in only the direction shown with an arrow E is transmitted to the bevel wheel 46. By setting the first, second, and third reverse rotation prevention mechanisms 20, 30, and 40 thus, the rotation of the grip handle 13 in the direction opposite to the direction shown with the arrow B is transmitted to the bevel wheel 14 through the third reverse rotation prevention mechanism 40. Consequently, the socket shaft 3 can be rotated in the direction shown with the arrow C. That is, the screw part 5 can be tightened. When the grip handle 13 rotates in the direction shown with the arrow B, the pawl 45 slides on the ratchet wheel 42. Thus, the rotation of the grip handle 13 is not transmitted to the bevel wheel 46, but transmitted to the transmission shaft 10 through the second reverse rotation prevention mechanism 30. The rotation of the transmission shaft 10 is transmitted to the bevel wheel 14 through the bevel wheel 15, similarly to the operation of the screw-rotating tool of the embodiment 1 described with reference to FIG. 2. Thus, the socket shaft 3 can be rotated in the direction shown with the arrow C. Accordingly, when the handle shaft 12 is rotated reciprocatorily by rotating the grip handle 13 clockwise and counterclockwise, the socket 7 can be rotated clockwise by the rotational force of the handle shaft 12. The reciprocatory rotation of the handle shaft 12 is unwastefully converted into the force for rotating the socket 7 clockwise. Thus, in addition to the effect of the embodiment 1, the screw-rotating tool of the embodiment 3 has the advantage of efficiently utilizing the operator's labor of rotating the handle shaft 12.

(4) Embodiment 4

Figure 6:
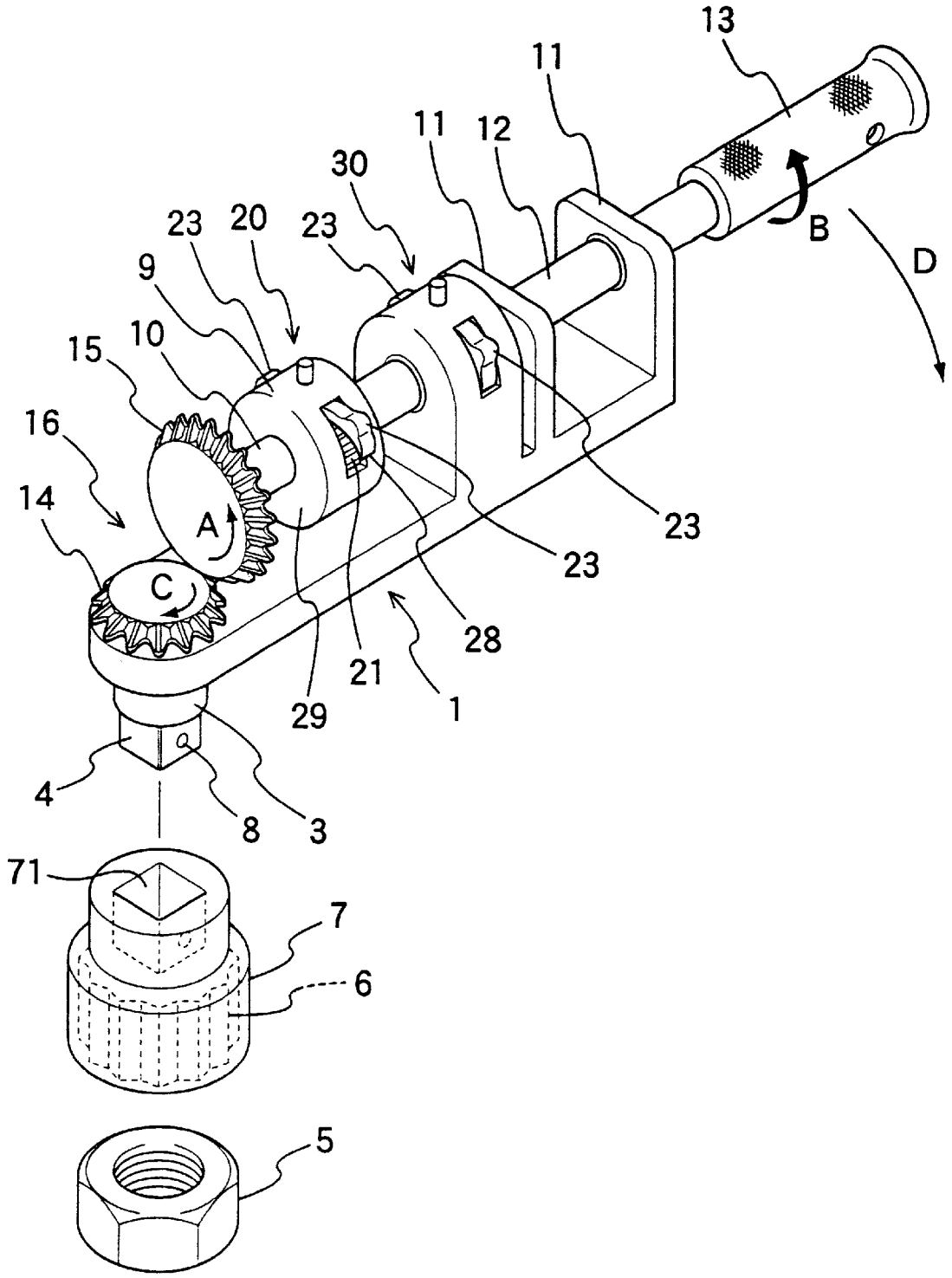
FIG. 6 is a perspective view showing a screw-rotating tool according to an embodiment 4 of the present invention.
Figure 7:
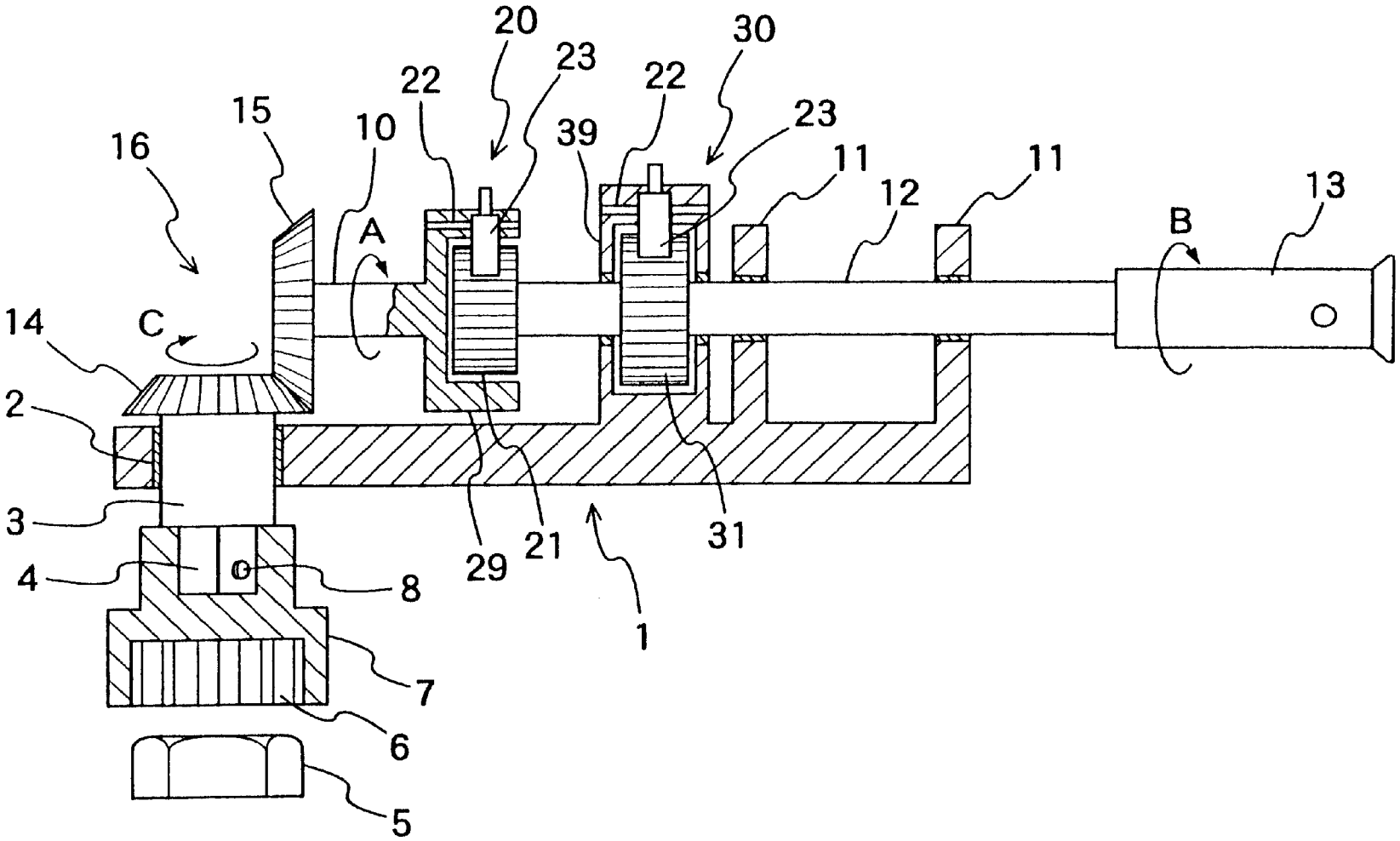
FIG. 7 is a side view partly in section showing a screw-rotating tool according to the embodiment 4 of the present invention.

The screw-rotating tool of the embodiment 4 shown in FIGS. 6 and 7 is similar to that of the embodiment 1. FIG. 6 corresponds to FIG. 1. FIG. 7 corresponds to FIG. 2. The frame 1 supports the socket shaft 3 rotatably. The transmission shaft 10 and the handle shaft 12 are rotatably supported on the frame 1 in an axial direction different from the axial direction of the socket shaft 3 The handle shaft 12 and the socket shaft 3 are substantially perpendicular to each other. Through the rotation transmission mechanism 16 consisting of the bevel wheels 14 and 15, the rotation of the transmission shaft 10 is transmitted to the socket shaft 3 whose axis is substantially perpendicular to that of the transmission shaft 10.

In the screw-rotating tool of the embodiment 4, the first reverse rotation prevention mechanism 20 is positioned at the portion of connection between the transmission shaft 10 and the handle shaft 12. The first reverse rotation prevention mechanism 20 limits both-way rotation of the transmission shaft 10 to be transmitted from the handle shaft 12 to one-way rotation. Reference numeral 29 denotes a cylindrical part integral with the handle shaft 12. The second reverse rotation prevention mechanism 30 is provided on the frame 1 to limit both-way rotation of the handle shaft 12 to one-way rotation. Reference numeral 39 denotes a bearing installed on the frame 1 to support the handle shaft 12.

Other constructions of the screw-rotating tool of the embodiment 4 are similar to those of the screw-rotating tool of the embodiment 1. The same reference numerals of the screw-rotating tool of the embodiment 4 as those of the screw-rotating tool of the embodiment 1 denote the same parts as those of the screw-rotating tool of the embodiment 1 or parts corresponding thereto. The screw-rotating tool of the embodiment 4 thus constructed has an operation and effect similar to that of the screw-rotating tool of the embodiment 1.

(5) Embodiment 5

Figure 8:
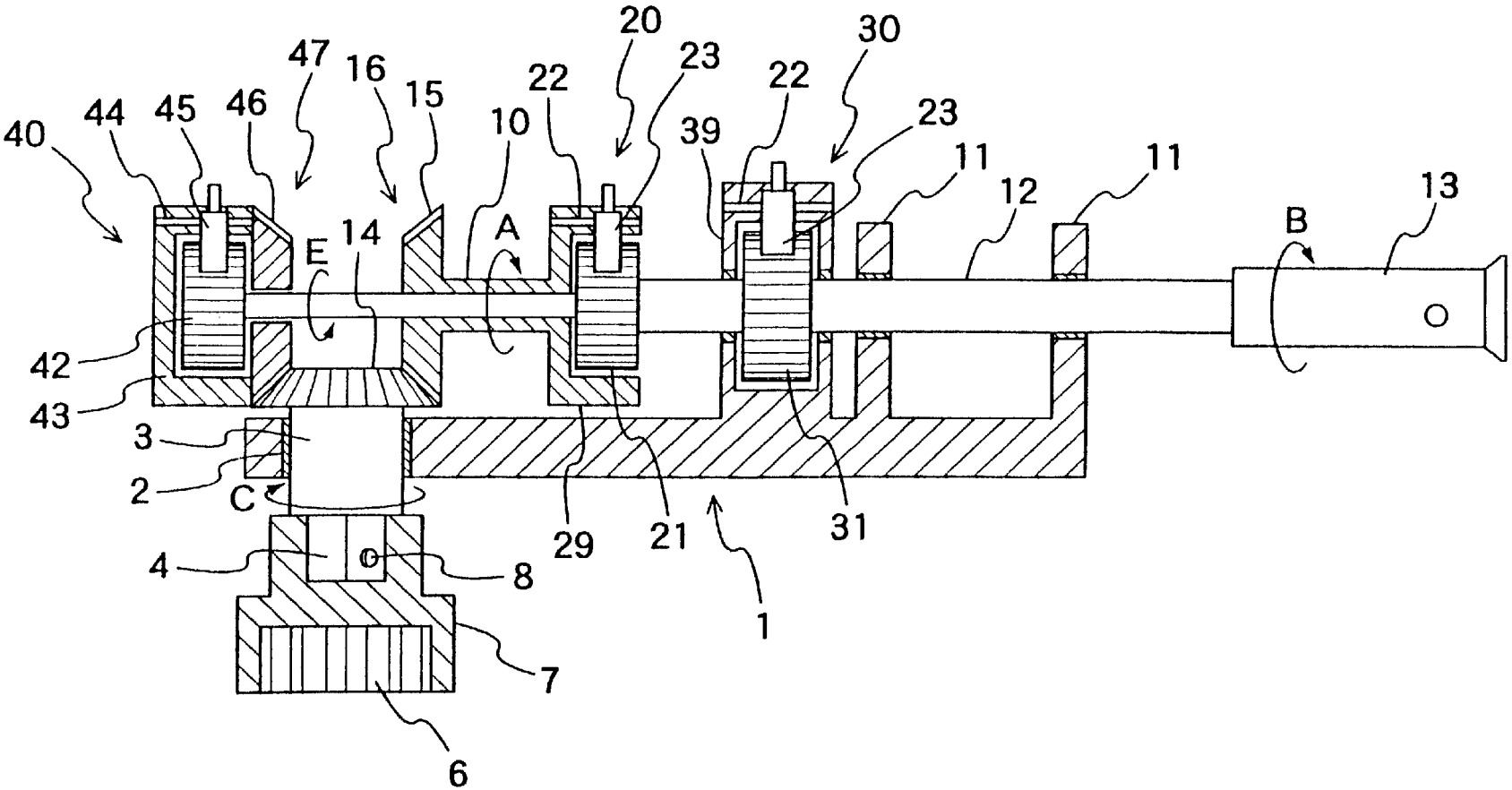
FIG. 8 a side view partly in section showing a screw-rotating tool according to an embodiment 5 of the present invention.

The screw-rotating tool of the embodiment 5 shown in FIG. 8 is similar to that of the embodiment 3. More specifically, the screw-rotating tool of the embodiment 5 includes the reversal rotation transmission mechanism 47 of the embodiment 3 and the third reverse rotation prevention mechanism 40 of the embodiment 3 in addition to the construction of the screw-rotating tool of the embodiment 4. The screw-rotating tool of the embodiment 5 thus constructed has an operation and effect similar to that of the embodiment 3.

The screw-rotating tool of the embodiments of the present invention may be modified within the scope of the present invention, according to purpose and use. Although the reverse rotation prevention mechanisms of the embodiments are constructed of the ratchet mechanism, the ratchet mechanism may be replaced with a ratchet mechanism having no gears or a ratchet mechanism of braking type. In the embodiments, the rotation of the handle shaft 12 is transmitted to the socket shaft 3 through the bevel wheels 14 and 15 such that the rotational speed of the socket shaft 3 is higher than that of the handle shaft 12. But it is not necessarily so. Further, tooth is not necessarily formed on the entire periphery of each of the bevel wheels 14 and 15 but may be formed on only an engaging region thereof. Instead of the bevel gears 14 and 15, friction wheels such as rubber rollers may be used as the rotation transmission mechanism 16. In addition, the rotation transmission mechanism 16 may be replaced with a universal joint or a flexible joint to allow the construction of the rotation transmission mechanism 16 to be simple.

Figure 9:
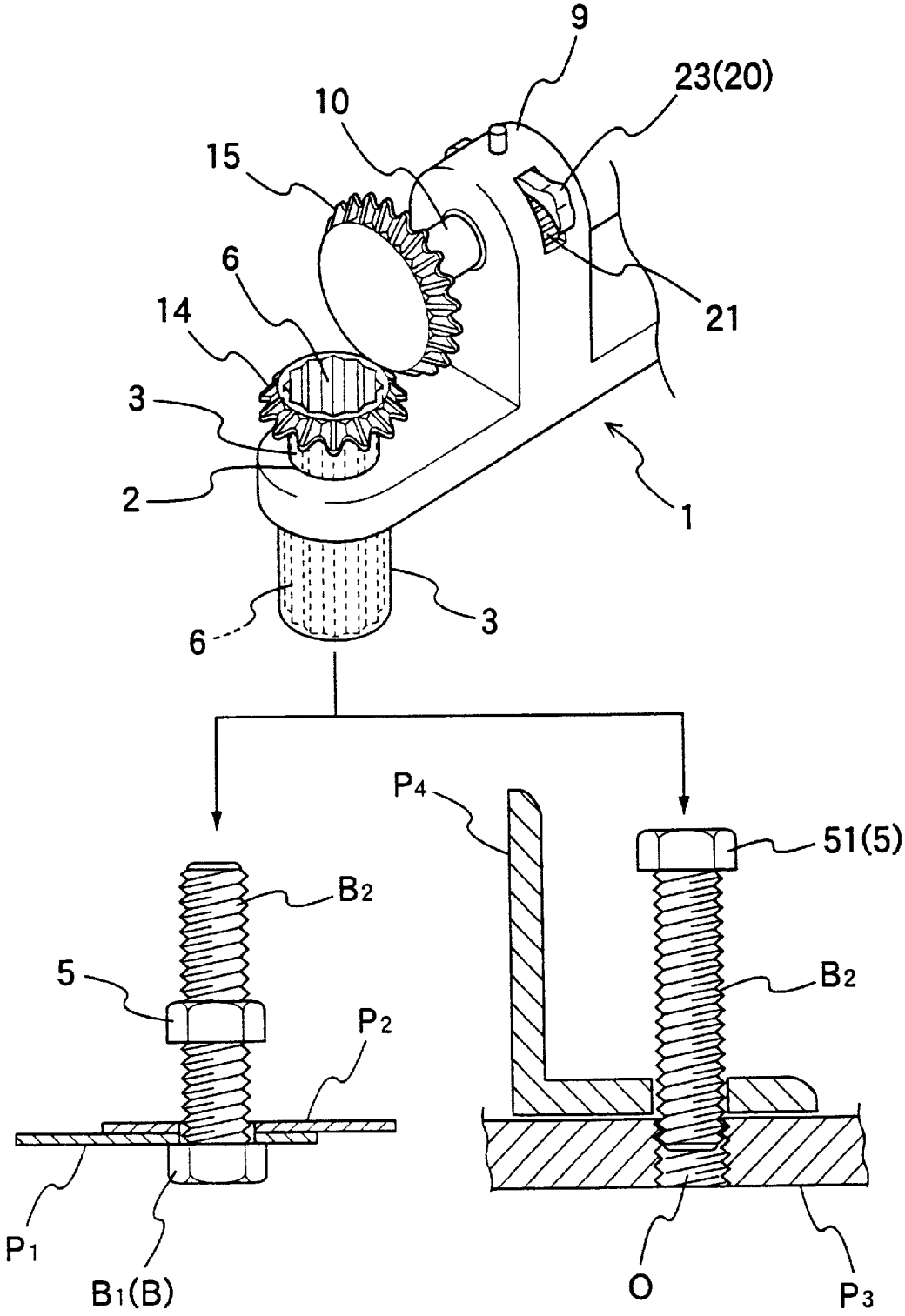
FIG. 9 is a partial perspective view showing a screw-rotating tool according to another embodiment of the present invention.
Figure 10:
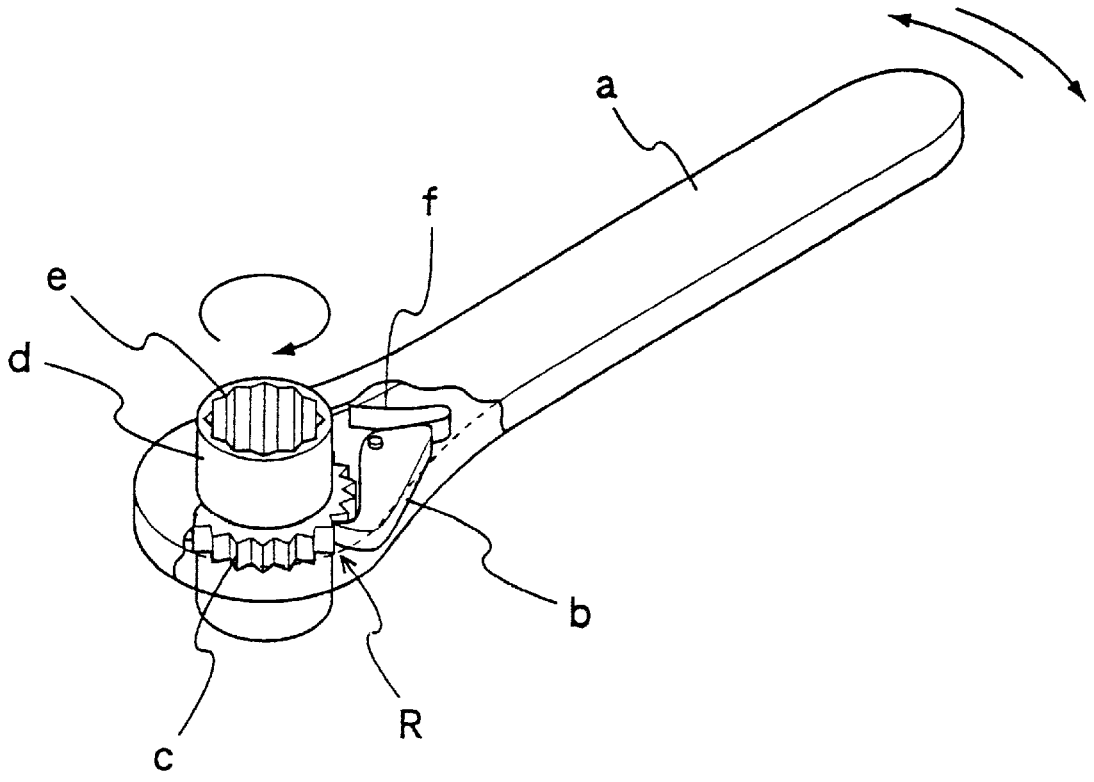
FIG.10 (PRIOR ART)
FIG. 10 is a perspective view partly in section showing a conventional ratchet tool.

In the present invention, a hollow pipe can be used as the socket shaft 3, as shown in FIG. 9. It is possible to penetrate a shaft $B_2$ of a bolt into the socket shaft 3 in tightening a nut 5 which is a screw part. Thus, even though the shaft $B_2$ is long, it is possible to tighten the nut 5 without interference. Further, the socket shaft 3 is suitable for tightening a bolt head 51 of the screw part 5 having the long shaft $B_2$. The concave engaging hole 6 of the socket shaft 3 can be so shaped that it can accommodate not only the bolt and nut shown in the embodiments, but also polygonal bolt heads and nuts. The engaging part of the socket 7 may be convex. For example, it may be cross bitt-shaped, minus bitt-shaped or hexagon rod-shaped so that the screw-rotating tool can be applied to screw parts having concave engaging portions formed on their heads. The socket 7 may be integral with the screw-rotating tool or may be separate therefrom, provided that the socket 7 can be installed on the screw-rotating tool when the screw-rotating tool is used.

The preferred embodiments described herein are therefore illustrative and not restrictive, the scope of the invention being indicated in the appended claims and all variations which come within the meaning of the claims and intended to be embraced therein.

What is claimed is:

1. A screw-rotating tool comprising:

a frame rotatably supporting a socket shaft;

a transmission shaft and a handle shaft rotatably supported on said frame in an axial direction different from an axial direction of said socket shaft being;

a rotation transmission mechanism connecting said socket shaft and said transmission shaft with each other, with the axial direction of said socket shaft and that of said transmission shaft different from each other;

a first reverse rotation prevention mechanism formed on said frame to limit both-way rotation of said transmission shaft to one-way rotation; and a second reverse rotation prevention mechanism limiting both-way rotation of said handle shaft to be transmitted to said transmission shaft to one-way rotation.

2. A screw-rotating tool according to claim 1, wherein said first and said second reverse rotation prevention mechanisms comprises a ratchet mechanism, respectively.

3. A screw-rotating tool according to claim 1, wherein said rotation transmission mechanism comprises bevel gears different in the number of teeth thereof at a socket shaft side and at a transmission shaft side.

4. A screw-rotating tool according to claim 1, further comprising a reversal rotation transmission mechanism transmitting a rotation of said handle shaft to said socket shaft by reversing a rotational direction of said handle shaft; and a third reverse rotation prevention mechanism limiting both-way rotation of said socket shaft to be transmitted from said handle shaft to one-way rotation.

5. A screw-rotating tool according to claim 4, wherein said both-way rotation of said transmission shaft, said handle shaft, and said socket shaft can be switched to one-way rotation by said first, second, and third reverse rotation prevention mechanisms, respectively.

6. A screw-rotating tool comprising:

a frame rotatably supporting a socket shaft;

a transmission shaft and a handle shaft rotatably supported on said frame in an axial direction different from an axial direction of said socket shaft;

a rotation transmission mechanism connecting said socket shaft and said transmission shaft with each other, with the axial direction of said socket shaft and that of said transmission shaft different from each other;

a first reverse rotation prevention mechanism formed at a portion of connection between said handle shaft and said transmission shaft to limit both-way rotation of said transmission shaft to be transmitted from said handle shaft to one-way rotation; and a second reverse rotation prevention mechanism formed on said frame to limit both-way rotation of said handle shaft to one-way rotation.

* * * * *